United States Patent [19]

Nehrenberg et al.

[11] Patent Number: 4,793,035

[45] Date of Patent: Dec. 27, 1988

[54] DYNAMIC CONTROL OF TEXTILE WARP SIZE ADD-ON ON A RUNNING SLASHER

[75] Inventors: Donald L. Nehrenberg, Charlotte, N.C.; Robert L. Washburn, Wilmington, Del.

[73] Assignee: E. I. Du Pont de Nemours and Company, Wilmington, Del.

[21] Appl. No.: 103,104

[22] Filed: Sep. 28, 1987

[51] Int. Cl.[4] ..... D02H 5/02

[52] U.S. Cl. ..... 28/183; 28/185; 364/470

[58] Field of Search ..... 364/470; 28/185, 183

[56] References Cited

U.S. PATENT DOCUMENTS 2,976,600 3/1961 Edgar ..... 28/183 X
3,253,315 5/1966 Eicken .

FOREIGN PATENT DOCUMENTS 481473 1/1973 Japan .
5918766 10/1984 Japan .

*Primary Examiner*—Robert R. Mackey

[57] ABSTRACT

The amount of textile warp size added to a sheet of threads in a running slasher is controlled by measuring the force applied to a separator bar, by passage of alternate threads on alternate sides of the bar. This force is the result of the dried size, which causes adjacent threads to adhere to each other. The force is compared to a predetermined value corresponding to the desired amount of size to be added to the threads. Based on this comparison, the pressure on the nip rolls is adjusted in order to squeeze more or less of the size solution from the threads. In this way, the amount of size added is maintained substantially equal to the predetermined value.

15 Claims, 4 Drawing Sheets

DYNAMIC CONTROL OF TEXTILE WARP SIZE ADD-ON ON A RUNNING SLASHER

BACKGROUND OF THE INVENTION

This invention relates to a process and apparatus for controlling the amount of warp size composition added to the threads on a running warp sizing apparatus.

Warp sizing is used to protect warp threads and prevent abrasion during the weaving process in textile manufacturing. Warp sizing consists of a coating, typically of starch or a polyvinyl alcohol-based composition, which is applied prior to weaving by running a "sheet" of threads through a size solution, followed by drying. The machine used to accomplish this is known in the art as a "slasher." Accurate and precise application of size solids is important for consistent high weaving efficiencies and for optimum economy. New high-speed looms, incorporating projectiles, rapiers, or air jets, have significantly narrowed the limits of size add-on for efficient performance. (Add-on is defined as the weight of warp size solids deposited on the yarn relative to the weight of the dry, unsized yarn, and is normally expressed as a percent). Traditionally, the textile industry has used more sizing than was required, to ensure that sufficient sizing was used. However, this is no longer practical, since oversizing as well as undersizing can have severely detrimental effects on weaving performance in modern looms. Oversizing can result in excessive shedding of excess size, which flakes off of the fibers due to abrasion. This excess size can cause buildup in the weaving looms, causing defects in the woven cloth and process interruptions. Oversizing can also result in excess tension in the loom. Undersizing results in weak warp yarns which may fail under the stresses applied in the loom. Undersizing also results in "hairy" yarn which interferes with the travel of the filling yarn across the warp, thus resulting in weaving defects, particularly when air jet looms are used. The present invention permits simple, accurate, and automatic control of size add-on.

Adjustment of the amount of size on textile warp yarns by manipulating pressure on the nip rolls in size boxes has been known for some time. However, all the known references involve controlling nip roll. spacing, either alone or in combination with the sheet speed, on the basis of a measured variable which is related only indirectly to the amount of size add-on. None measures deposited size solids directly.

U.S. Pat. No. 3,253,315, Eiken, discloses an apparatus for measuring the electrical resistance of the warp sheets emerging from a size box, and adjusting this parameter to a preset value by adjusting the spacing of the squeeze rollers. This adjustment can be used in combination with means for controlling the speed of advancement of the sheet so that a given quantity of sizing will be obtained on the sheet for a particular constant pressure applied to the sheet by the squeezing rollers.

Another method which has been used is measurement of the amount of size consumed over a given interval using a flowmeter. The integrated reading is compared to a set point whose value is determined by calculation from an assumed rate of liquid pick-up for the particular yarn and the formulated level of solids in the size solution.

Japanese document No. 59-187662-A, Nisshin Spinning, discloses use of an electric signal representing the viscosity of the size to control spacing of the rollers to maintain a constant level of the liquid picked up by the sheet. The signal is sent to a programmable control unit to provide an output signal which is converted into air pressure, which pressurizes the squeeze rollers so that sizing is controlled. The electrical signal representing viscosity is combined with a second electrical signal representing speed, and a third reference signal. These signals are fed into a specially programmed computer whose output signal is converted to an electropneumatic converter to give a pneumatic pressure according to the monitored conditions Measurement of viscosity itself is accomplished by intermittently filling a calibrated orifice cup to a given level and the measuring the time it takes to empty through the orifice.

Japanese document No. 73-01473-R, as reported in Derwent Abstract 17279U-F, discloses control of the amount of size by dielectric measurement of "sheet moisture regain."

In spite of these efforts, there has been no reported method or apparatus for direct on-line measurement of the "add-on", or amount of dry warp size material added to the threads of a warp sizing apparatus (slasher) or use of such a measurement to adjust the amount of add-on to the desired level.

BRIEF SUMMARY OF THE INVENTION

The present invention provides an improved process for applying warp size to warp threads in a slasher, comprising:

(i) passing a sheet of parallel warp threads through a warp size solution;

(ii) squeezing excess size solution from the threads by passing the threads between an adjustable pair of nip rolls, wherein one nip roll of said pair exerts a pressure on the threads and on the other nip roll;

(iii) drying the threads so that substantially all of the solvent of the size solution is evaporated from the threads, resulting in a sheet of sized threads in which adjacent threads tend to adhere to one another due to the dried size;

(iv) separating adjacent threads by running alternate threads on alternate sides of a transversely mounted separator bar, whereby a force is applied by the threads to the separator bar, which force is related to the amount of added size on the threads; and (v) thereafter recombining the separated threads into a single sheet; the improvement of which comprising:

(a) measuring the force applied by the threads to the separator bar;

(b) comparing said force with a preset value, which preset value corresponds to a predetermined amount of size to be added to the threads; and (c) adjusting the pressure exerted by the nip roll by reducing the pressure when the measured force is less than the preset value and increasing the pressure when the measured force is greater than the preset value, such that the difference between the measured force and the preset value is made substantially zero, whereby the amount of warp size added to the threads is maintained at the predetermined amount.

The present invention further provides an improved apparatus for applying warp size to a moving sheet of warp threads, comprising:

(i) a means for supplying the sheet of warp threads;

(ii) a means for applying a warp size solution to said sheet of warp threads;

(iii) a pair of adjustable nip rolls through which the sheet of warp threads is made to pass, wherein one nip roll of said pair exerts a pressure on the sheet of warp threads and on the other nip roll, whereby excess size solution is squeezed from the threads;

(iv) a drier through which the sheets pass after passing between the nip rolls;

(v) a transversely mounted separator bar located after the drier, around which alternate threads of the sheet pass on alternate sides and to which the threads apply a force, which force is related to the amount of added size on the threads; and (vi) a means for recombining the separated threads into a single sheet; the improvement of which comprising:

(a) a means for measuring the force applied by the threads to the separator bar; and (b) a controller adapted to compare the first output signal, from the force measuring means, with a preset value, which preset value corresponds to a predetermined amount of size added to the threads, and further adapted to produce a second output signal determined by the comparison of the first output signal with the preset value.

DETAILED DESCRIPTION OF THE INVENTION

Figure 1:
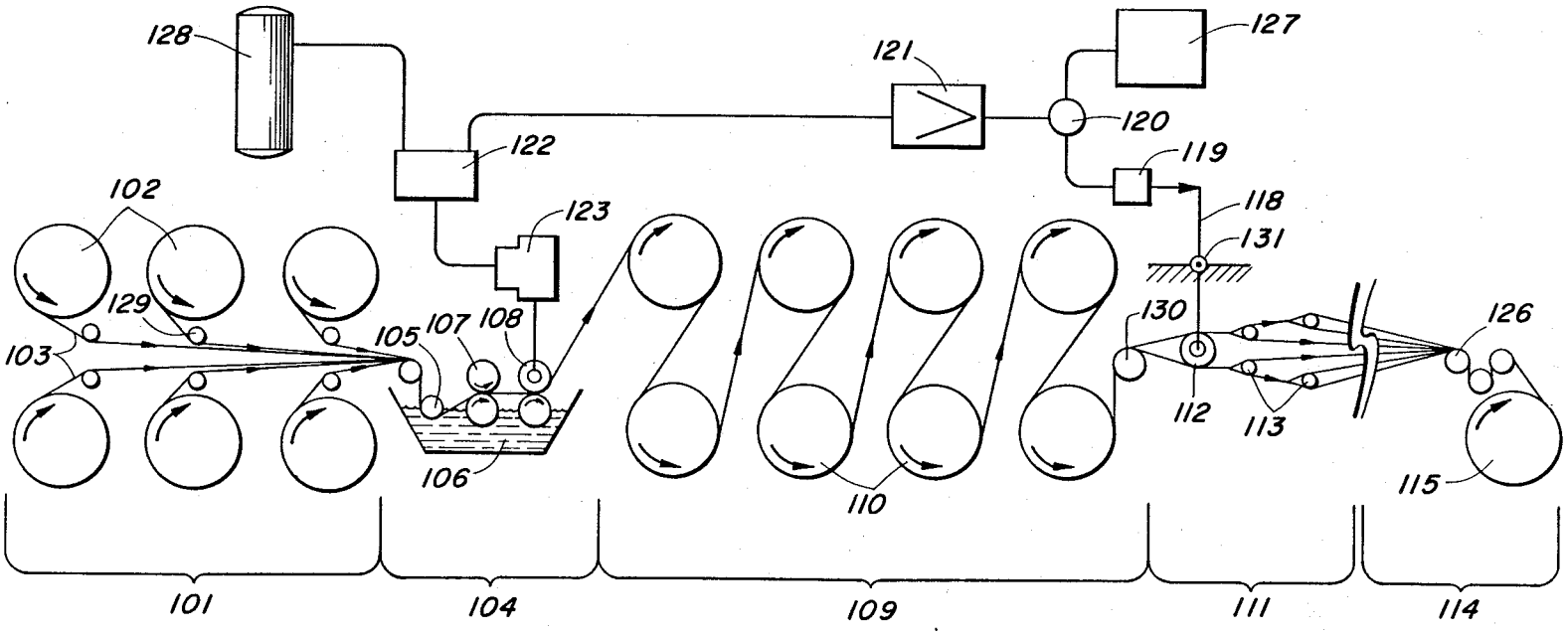
FIG. 1 is a simplified diagram of a slasher equipped with one embodiment of the present invention.

FIG. 1 is a simplified diagram of a typical slasher, equipped with one embodiment of the present invention. The slasher itself may be of any of a variety of designs, but the one illustrated consists of five sections. The first section [101] is the creel section, which consists of a number of beams [102], each of which supplies a sheet of threads [103], each composed of a plurality of individual parallel ends of thread. The individual sheets may pass over a number of rollers [129] and are combined into a single sheet, which passes into the next section of the slasher, the size box [104]. (Commercial slashers may have as many size boxes as required for the warps to be sized; most have up to four). In the size box, the sheet is passed under an immersion roll [105] into the size solution [106]. Size solutions are generally aqueous solutions of polyvinyl alcohol and/or starch, optionally with other additives, which are well known in the art. Included among such additives are urea, enzymes, foam enhancers, stearic hindrance adjuvants, antistatic agents, wax, and wax substitutes, such as low ethylene oxide adducts of branched alcohols. Examples of compositions containing the latter may be found in U.S. Pat. No. 4,640,446. After leaving the size solution, the sheet passes between at least one pair of squeeze rolls [107] including a final pair, also called the nip rolls [108]. The squeeze rolls and nip rolls squeeze the excess size solution from the sheet. Normally at least one member of each pair of squeeze rolls will have a surface coating of rubber, to more effectively squeeze the excess size from the sheet. If more than one pair of rolls are present, the nip rolls will normally be operated under higher pressure than the other squeeze rolls. In this way, the other squeeze rolls may remove the bulk of the size solution, but the nip rolls will still be "flooded" with excess size solution. In this way the nip rolls can more precisely remove the remainder of the excess size solution.

Figure 2:
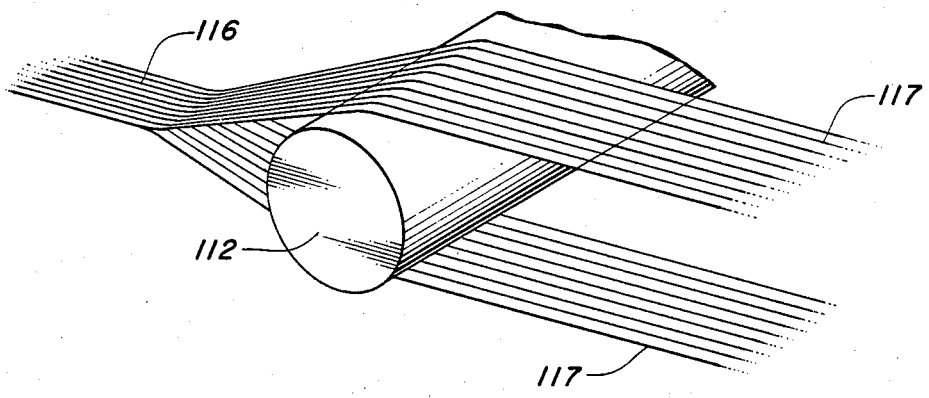
FIG. 2 shows in more detail a sheet of threads being separated by a separator bar (bust bar).

After leaving the size box, the sheet passes through a drier section [109], passing over a number of heated rollers or cans [110], during which time the water from the size solution is evaporated. The dried sheet then passe optionally over one or more rollers [130] and into the bust and lease section [111]. The individual threads of the sheet here encounter a number of separator bars mounted transversely to the movement of the sheet. The first of these, and the only one to be considered in detail hereinafter, is also called the bust bar [112]; successive bars, which perform much the same function as the bust bar, are referred to as lease bars [113]. FIG. 2 shows a portion of the bust bar in more detail. As the sheet of threads [116] approaches the bust bar, the adjacent threads in the sheet tend to adhere to each other because of the dried size coating. Alternate ends of thread are passed on alternate sides of the bust bar (and other separator bars), thereby separating adjacent ends of thread from each other, so that the ends become well separated [117].

Other separating schemes are possible, of course, which are considered equivalent for purposes of this invention. For example, sometimes it is desired to separate, or "peel off", at the bust bar, only a single sheet of threads, corresponding to a sheet [103] originating from a single beam [102]. In such an arrangement the threads might be separated by passing alternately five threads on one side of the bar and one thread on the other side, and so on. Other sheets might then be similarly peeled off at later separator bars. Such arrangements are considered to be included in the concept of passing alternate threads on alternate sides of the bust bar.

Finally (FIG. 1), the separated ends are fed to the front of the slasher [114] where they are again combined into a single sheet by passing all the threads over one or more common rollers, [126], and are wound onto the loom beam [115].

Figure 3:
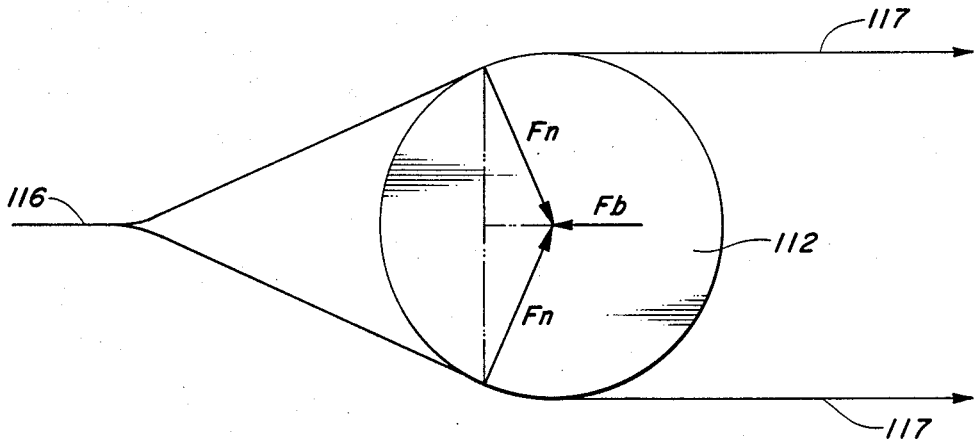
FIG. 3 shows the distribution of forces about a separator bar in operation.

A certain amount of force is generated by the ends of thread as they pass over the bust bar ($F_n$ in FIG. 3). This is the force generated from separation of the adjacent ends, due to the adhesion caused by the dried size. A component of the force is applied to the bust bar as a net force, which is in the same direction as the motion of the ends. The equal and opposite reaction to this net force is the "bust force," $B_f$.

An important feature of this invention is the measurement of this bust force. It has been found that the bust force is directly related to the amount of size deposited on the sheet. One object of this invention is to use the measurement of the bust force to control the amount of size add-on.

In order to measure the bust force, the bust bar must be mounted in such a way that the bust force can be transferred to a sensor. Although there are many ways in which this may be accomplished, each such method requires that the bust bar be mounted in such a way as to be variably displaced in response to variations in the bust force. By this expression it is meant that the bust bar is not rigidly attached to the fixed frame of the slasher (or to some other immovable structure). Rather, there is some movement or "play" in the mounting of the bust bar. This play can be produced by any convenient means, such as by pivoting of the support for the bust bar, by providing a horizontal surface over which the bust bar can slide, or by providing a support for the bust bar that itself has some elasticity and can flex. The important feature is that by using whatever appropriate method, the bust force is not directly supplied by the fixed frame of the slasher, but rather is transmitted at least in part through a force measuring device. A simple force measuring device may be a simple calibrated spring scale. In that case a significant amount of free movement of the bust bar may be required, in order for the spring to properly elongate or compress in response to variations in the bust force. On the other hand, the force measuring device may be an electronic load cell. Such a device will require only an almost immeasurably small amount of movement of the bust bar in order for the full range of force to be measured. The term "variably displaced," thus, is intended to cover both extremes, and to indicate the transmission of the bust force through a force measuring device.

Figure 4:
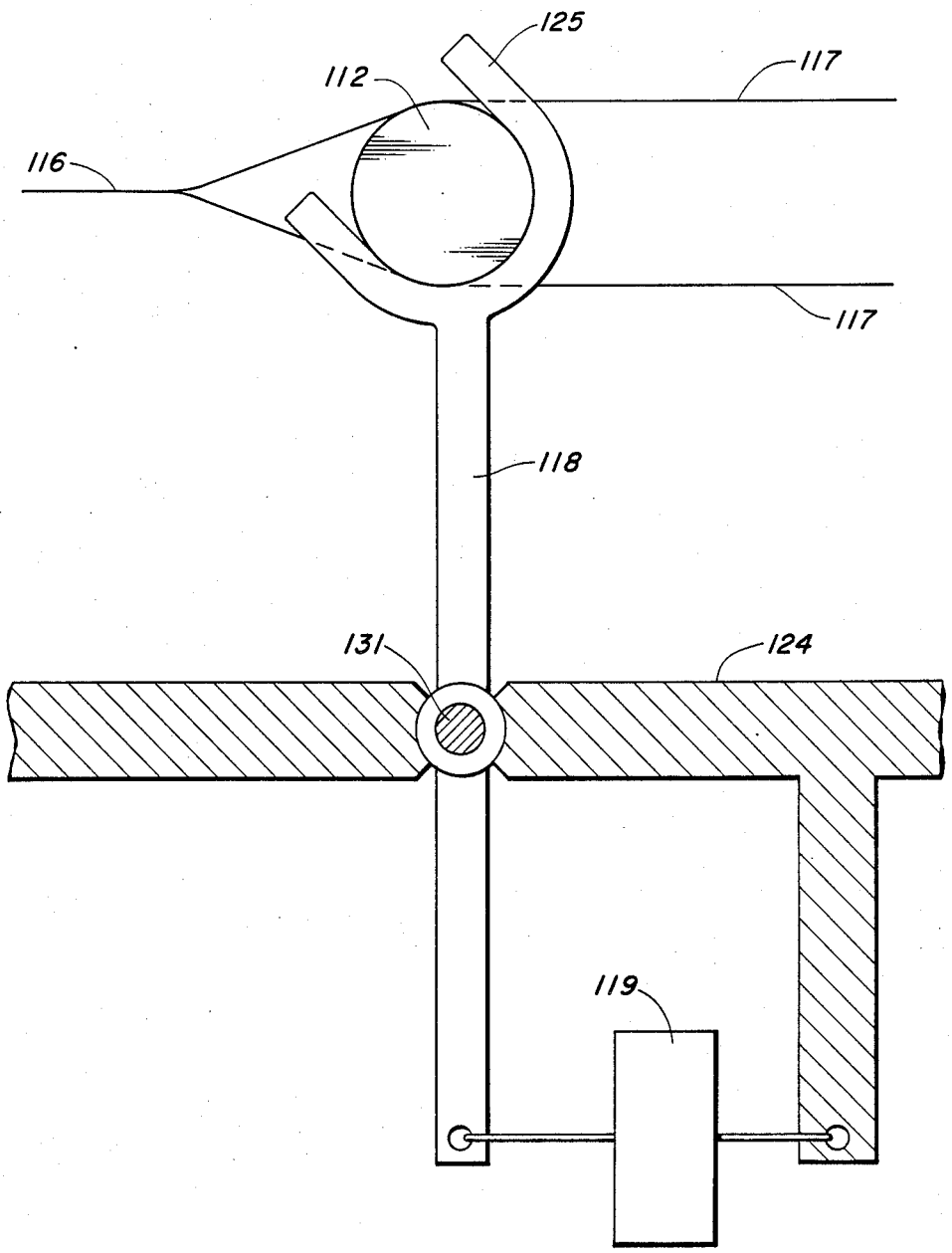
FIG. 4 shows the details of the mounting of the separator bar assembly in one embodiment of the invention.

A preferred way to mount the bust bar and force measuring device is shown in FIG. 4. In this embodiment, the bust bar is removably mounted in a U-shaped holder [125] attached to the upper end of a lever [118]. The lever is attached to the fixed frame of the slasher [124] by means of a pivot [131], and mechanically transmits the bust force through a force measuring device [119], to the bust bar, thus providing physical linkage between the two. In this case the force measuring device is a load cell, which is removably fastened to both the lever and the fixed frame. The number of acceptable alternatives ways to mount the bust bar and force measuring device are too numerous to list. For example, a load cell, set up to measure compressive force, may be mounted directly adjacent to and in direct physical contact or linkage with the bust bar, such that changes in the bust force are directly transmitted from the load cell to the bust bar without any intermediate lever system. The present invention is not limited to any particular method for mounting the bust bar and force measuring device.

It is of course recognized that the total bust force will be the sum of the forces measured at each end of the bust bar. A true measurement of the bust force would require simultaneous measurement at both ends of the bust bar, or measurement by some other means whereby the total force is measured. However, for practical purposes it is accurate enough to measure the bust force at one end, and multiply the value by two. For most industrial purposes, the single measurement at one end of the bust bar alone will provide enough information to permit satisfactory control of the warp sizing process. However, for some purposes, as described below, simultaneous measurement at both ends of the bust bar may be desired.

In a simple embodiment, this measurement device might be a simple mechanical force gauge. In this case the bust force may be measured visually, permitting slasher operators to manually adjust the pressure of the nip roll to maintain the desired amount of size add-on.

However, in a preferred embodiment, the force measurement device [119] is an electronic load cell, which will be suitable for automatic, continuous, electronic monitoring of the bust force. The load cell converts the force into an electronic signal which is proportional to the force. (One such load cell which may been used is a LeBow TM #3397 transducer, which is a Wheatstone bridge.) The signal from the load cell (normally in the form of a voltage) is sen to a controller [120], shown in FIG. 1. The controller compares the signal from the force measurement device with a preset value which corresponds to a predetermined amount of size to be added to the sheet of threads. This comparison is preferably done electronically. If the actual signal differs from the preset value by a predetermined amount, the controller may, in a simple case, automatically activate an alarm [127] or other output device, to indicate to slasher operators that the bust force, and hence the size add-on, is either too high or too low. It is preferred, however, that the controller be used to control the amount of size add-on automatically and continuously, with or without an alarm system. It has been shown that a Dianachart TM PCA 14 channel electronic data acquisition system, available from Dianachart, Inc., Rockaway, N.J., will serve efficiently as part of such a controller system, but any of a wide variety of controllers can be envisioned. The controller may include a microcomputer as one component. The use of controllers in a feedback situation is well known to those skilled in the art. In such a preferred embodiment, the controller is set up such that when the actual signal differs from the preset value by a predetermined amount, a control signal will be sent (optionally via an amplifier [121])to a converter [122]. The converter converts the electrical control signal into a mechanical force. One such converter is a Belofram TM Type 1000 I/P transducer, available from Belofram Corporation, Burlington Mass., which is an electropneumatic device which reduces a supply pressure to a regulated output pressure that is directly proportional to an electrical input signal. The supply pressure is derived from an air supply cylinder [128], and the output pressure is applied to a nip roll loading cylinder [123]. (Of course, any of a wide variety of electrical-mechanical converters might be used). The force or pressure thus generated is applied to the nip roll [108]. Of course, there will usually be a fixed pressure at the nip roll, so that the variably applied pressure, in response to the bust force, will normally be an additional, proportional force or pressure. The variably applied pressure is thus adjusted, preferably automatically and continuously, by the control system described above. Thus the system is most preferably set up so that an increase in bust force, indicating an increase in size add-on, will cause the converter to generate an increased force, resulting in increased pressure on the nip roll, thereby squeezing out more size solution from the sheet of threads. Conversely, a decrease in bust force, indicating a decrease in size add-on, will cause the converter to generate a reduced force, resulting in a reduction of pressure on the nip roll, thereby allowing more size solution to remain on the sheet.

Figure 5:
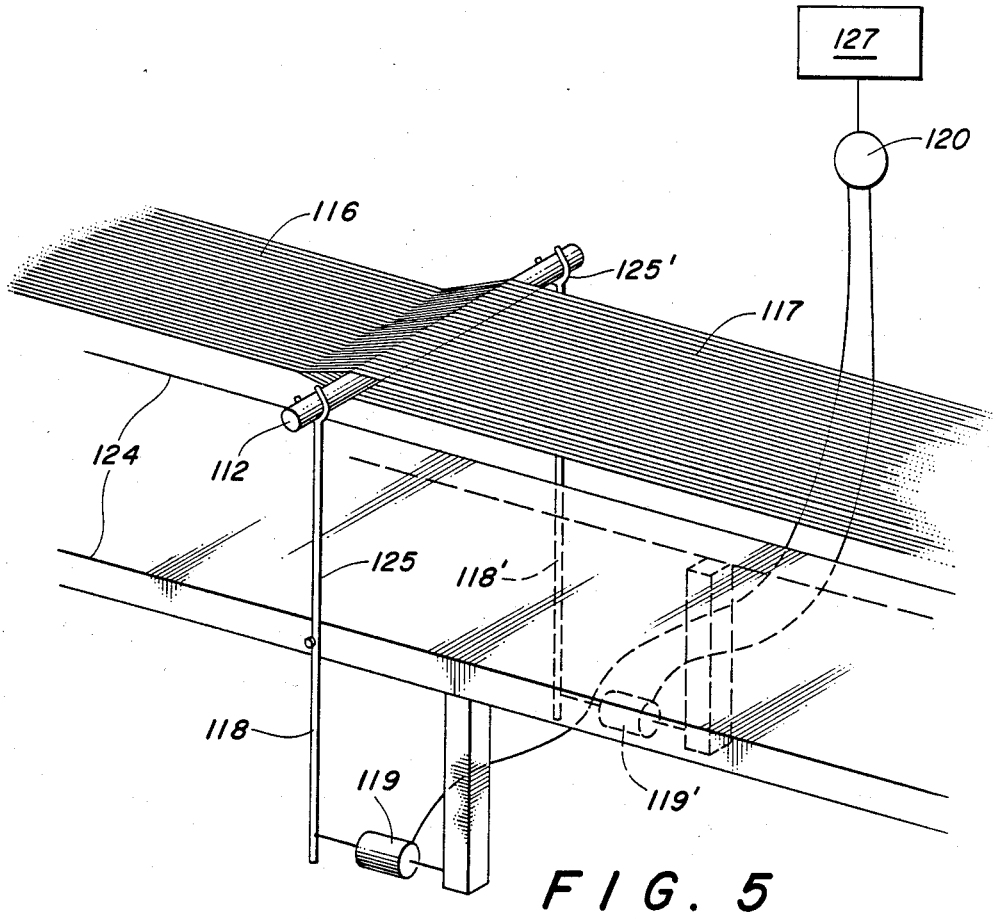
FIG. 5 shows a detail of an embodiment in which force measurement is made at each end of the separator bar, and the results are fed to a common controller.

While a single load cell assembly may be used to measure the butt force at a bust bar, other arrangements are possible. For example, force measurements may be made at both ends of the bust bar, as shown in FIG. 5. By comparing these two measurements, by any of the methods described above, it is possible to determine whether there is a significant imbalance between one side of the bar and the other, which could indicate a malfunction in the slasher, such as a misalignment of the bar, a mechanical fault in the pressure rolls or the pneumatic pressure system, or unbalanced tension in the threads across the sheet. Such a system may be set up to automatically compare these measurements and automatically activate an alarm when the measurement from one end of the bust bar deviates from that of the other by a predetermined amount.

Figure 6:
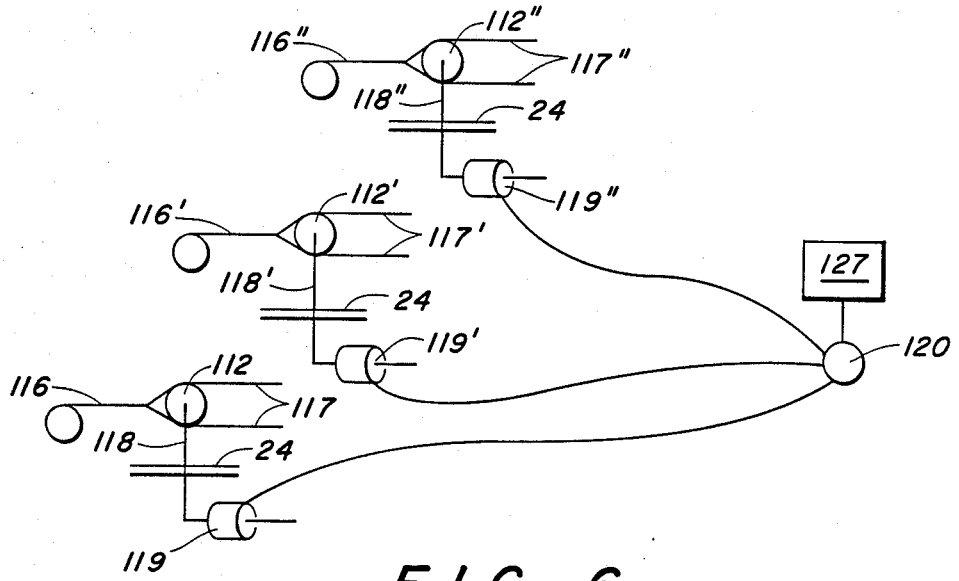
FIG. 6 is a schematic presentation of an embodiment in which the forces exerted by several sheets of threads in a slasher are separately measured and the results fed to a common controller.

Similarly, in a multiple box slasher, each sheet of threads will pass through a size box containing a warp size solution, and then through its own respective pair of nip rolls and across its own respective separator bar or bust bar. In such a setup, one or more bust force sensors may be placed at a bust bar corresponding to each separate sheet of threads, as shown schematically in FIG. 6. The bust force from each bust bar may the be measured independently of the others and compared to a preset value. The pressure for the nip roll for each box may be thus independently controlled as described above. Several modifications of such control systems are possible within the scope of this invention. For example, it is possible that the bust force measurement from one of the bust bars can be used as the standard or "preset" value for comparing and controlling the bust forces from the other bust bars. In addition, significant differences in the bust force measurement from the different bust bars can indicate, as above, a mechanical malfunction in the slasher, or differences in the concentration, temperature, or other properties, among the size compositions in the various size boxes. An appropriate alarm system may also be used here.

The main advantage of the present invention over the devices of the prior art is that the present invention provides for a system which can be completely self compensating. Changes in any of a large number of variables can affect the amount of add-on in a running slasher, but any such change results in a change in bust force. For example, if the size concentration in the size box changes, the change will be reflected in a change in bust force. Similarly, aging of the rubber coating on a nip roll, which could result in a change in the pressure between the nip rolls and thus a change in add-on, will likewise result in a corresponding change in bust force. A change in the line speed could change the add-on, but this will again result in a change of bust force. If any of these or similar changes occur, an automated feedback system as described above, based on measurement of the bust force, can automatically compensate for the change and will result in a constant level of add-on.

EXAMPLES

Useful linear relationships between bust force and add-on were found over a wide variety of size formulations ranging solutions based on polyvinyl alcohol to those based on starch solution, and mixtures thereof. Formulations including various combinations with other commonly used warp sizing ingredients such as wax, cabboxymethylcellulose, antistatic compounds, etc., have also been successfully run. Experiments were run in six plants to demonstrate that there is a useful, linear relationship between bust force and size add-on, and that both of these measurements vary with the nip roll applied pressure.

Examples 1–3. The data for these examples were all taken from a single slasher at a plant, using yarn composed of a 50/50 blend of cotton and polyester. The size solution was based on a composition of polyvinyl alcohol containing a wax substitute. The concentration of size in the size boxes was varied by dilution as indicated in the Table. The concentrations of the size solution were sufficiently similar from one example to the next that the viscosity of the solution did not vary, as seen by the nearly identical wet pick up for these examples. Loading pressure on the nip roll was kept constant. It can be seen that, as the solids concentration was increased, the bust force and add-on both increased.

Examples 4 and 5, from a different plant, used a PVA-based size solution containing wax and anti-skinning additive. These examples used 100% cotton yarn, having an inherently higher wet pick-up than the yarn of examples 1–3. Bust force and add-on are seen to vary inversely with roll pressure.

Examples 6 and 7, from yet another plant, used a same size solution based on polyvinyl alcohol with urea and a wax substitute. The yarn was a 50/50 blend of cotton and polyester. These examples show the variation of add-on and bust force with roll pressure using a size composition with lower solids concentration, lower add-on levels, and using a finer cotton count.

Examples 8 and 9, from another plant, used a size solution based on polyvinyl alcohol, with wax, pearl starch, enzymes, and a foam enhancer. The yarn was a 50/50 blend of cotton and polyester. These examples use even finer yarn (higher cotton count) with significantly closer spacing of threads in the sheet. The bust force is higher due to the much closer spacing of the warp threads for this particular weave. Once again, bust force and applied pressure are seen to be inversely related.

Examples 10–12 are from a high pressure slasher. This slasher operates at a higher fixed pressure on the dresser rolls, to wring out more of the size from the sheet. In this way, less energy is used in evaporation to dry the yarn because a higher solids content can be used in the size solution. Examples 10 and 11 were prepared using a size prepared from polyvinyl alcohol, containing wax, a foam enhancer, and an antistatic agent. Example 12 was prepared using a similar size solution, which was prepared from a 50/50 mixture of partially hydrolyzed polyvinyl alcohol and starch composition also containing a steric hindrance adjuvant. In these experiments, the yarn was a 50/50 polyester/cotton blend. The solids content, bust force, and add-on in example 12 are higher than that in examples 10 or 11. This is necessary since the starch is an inherently weaker polymer than is PVA.

Example 13 is from another high pressure slasher, run under similar conditions as examples 10 and 11. The variations among these examples illustrate the typical variations in conditions which are encountered on similar machines in different plants.

Example 14–16 are from experiments in which thread composed of a 50/50 blend of polyester and rayon was used. The size solution for example 14 was based on 17% polyvinyl alcohol and 83% starch. The amount of size material which was shed from these threads in the weaving process was high, causing problems in the loom. In example 15, the composition of the size was changed to 30% polyvinyl alcohol, 70% starch, and the solids content of the size solution was reduced as indicated in the table. In example 16, the compositions were the same as in example 15, but the nip pressure was increased. The response of the bust force and level of add-on in these experiments is consistent with the earlier results, illustrating that the present invention is operable using a wide variety of yarn and size compositions.

TABLE[1]

| EX. | COTTON COUNT | % SOLIDS IN SIZE | WET PICK-UP, % | ADD-ON % | BUST FORCE/ 1000 ENDS N | APPL. NIP PRESS kPa |
|---|---|---|---|---|---|---|
| 1 | 21.5 | 7.5 | 111 | 8.3 | 19.9 | 172 |
| 2 | " | 8.8 | 110 | 9.7 | 21.6 | 172 |
| 3 | " | 9.4 | 110 | 10.3 | 23.2 | 172 |
| 4 | 20 | 8.0 | 146 | 11.7 | 23.8 | 172 |
| 5 | " | 8.0 | 131 | 10.5 | 19.8 | 207 |
| 6 | 28 | 6.8 | 137 | 9.3 | 17.2 | 103 |
| 7 | " | 6.8 | 127 | 8.6 | 14.4 | 172 |
| 8 | 35 | 10.2 | 153 | 15.6 | 17.8 | 124 |
| 9 | " | 10.2 | 121 | 12.3 | 14.0 | 172 |
| 10 | 36 | 12.4 | 104 | 12.9 | 19.7 | 69 |
| 11 | " | 12.4 | 119 | 14.7 | 25.7 | 55 |
| 12 | " | 14.3 | 114 | 16.3 | 26.1 | 69 |
| 13 | 34.5 | 12.5 | 103 | 12.9 | 26.4 | 103 |
| 14 | 35.5 | 14.0 | 130 | 20.0 | 28.0 | 124 |
| 15 | " | 11.0 | 127 | 14.0 | 24.0 | 124 |
| 16 | " | 11.0 | 114 | 12.5 | 22.2 | 172 |

[1]Cotton count is the number of 840 yard (768 m) hanks of a given size yarn to equal one pound (454 g). The larger the cotton count, the smaller the yarn size. Wet pick-up is weight of liquid size picked up in the size box, divided by the weight of the dry unsized yarn. The applied nip pressure is the additional (air) pressure applied to the cylinder or diaphragm system loading onto the nip or squeeze roll cylinder.

We claim:

1. In a process for applying warp size to warp threads in a slasher, comprising:

(i) passing a sheet of parallel warp threads through a warp size solution;

(ii) squeezing excess size solution from the threads by passing the threads between an adjustable pair of nip rolls, wherein one nip roll of said pair exerts a pressure on the threads and on the other nip roll, (iii) drying the threads so that substantially all of the solvent of the size solution is evaporated from the threads, resulting in a sheet of sized threads in which adjacent threads tend to adhere to one another due to the dried size;

(iv) separating adjacent threads by running alternate threads on alternate sides of a transversely mounted separator bar, whereby a force is applied by the threads to the separator bar, which force is related to the amount of added size on the threads; and (v) thereafter recombining the separated threads into a single sheet;

the improvement which comprises:

(a) measuring the force applied by the threads to the separator bar;

(b) comparing said force with a preset value, which preset value corresponds to a predetermined amount of size to be added to the threads; and (c) adjusting the pressure exerted by the nip roll by reducing the pressure when the measured force is less than the preset value and increasing the pressure when the measured force is greater than the preset value, such that the difference between the measured force and the preset value is made substantially zero, whereby the amount of warp size added to the threads is maintained at the predetermined amount.

2. The process of claim 1 wherein the measuring, comparing, and adjusting steps are done manually.

3. The process of claim 1 wherein the measuring, comparing, and adjusting steps are done automatically.

4. The process of claim 3 wherein the measuring and comparing steps are done electronically and the adjusting step is done electropneumatically.

5. The process of claim 4 wherein the measuring, comparing, and adjusting steps are done continuously.

6. The process of claim 1 wherein the measuring and comparing steps are done automatically and continuously, and further comprising the step of automatically activating an alarm when the measured force deviates by a predetermined amount from the preset value.

7. The process of claim 1 wherein the force applied by the threads to the separator bar is automatically measured at each end of the separator bar, further comprising the steps of:

(d) automatically comparing the measurement from one end of the separator bar with the measurement from the other end; and (e) automatically activating an alarm when the measurement from one end of the separator bar deviates from that of the other end by a predetermined amount.

8. The process of claim 1, wherein the slasher comprises a plurality of pairs of nip rolls and a plurality of separator bars, a separate sheet of threads passing through each such pair of nip rolls and passing around each such separator bar, wherein the force applied by each sheet of threads to its corresponding separator bar is measured independently of the other forces, each such force is compared to a preset value, and the pressure on the nip roll corresponding to each such sheet of threads is adjusted such that the difference between the measured force and the preset value for each sheet of threads is substantially zero.

9. The process of claim 8 wherein the measurement of force at one separator bar is used as the preset value for comparison of measurements of the forces at the other separator bars.

10. In an apparatus for applying warp size to a moving sheet of warp threads, comprising:

(i) a means for supplying the sheet of warp threads;

(ii) a means for applying a warp size, solution to said sheet of warp threads;

(iii) a pair of adjustable nip rolls through which the sheet of warp threads is made to pass, wherein one nip roll of said pair exerts a pressure on the sheet of warp threads and on the other nip roll, whereby excess size solution is squeezed from the threads;

(iv) a drier through which the sheets pass after passing between the nip rolls;

(v) a transversely mounted separator bar located after the drier, around which alternate threads of the sheet pass on alternate sides and to which the threads apply a force, which force is related to the amount of added size on the threads; and (vi) a means for recombining the separated threads into a single sheet;

the improvement which comprises:

(a) a means for measuring the force applied by the threads to the separator bar and for producing an output signal determined by said force; and (b) a controller adapted to compare the output signal from the force measuring means with a preset value, which preset value corresponds to a predetermined amount of size to be added to the threads, and further adapted to produce a control signal determined by the comparison of the output signal from the force measuring device with the preset value.

11. The apparatus of claim 10, further comprising an alarm system attached to the controller and adapted to activate an alarm when the control signal indicates that the force applied by the threads deviates from the preset value by a predetermined amount.

12. The apparatus of claim 10 further comprising:

(c) a converter adapted to generate a force based on the control signal; and (d) a means for applying the force generated from the converter to the nip roll.

13. The apparatus of claim 12 wherein the force measuring means is an electronic load cell and the means for applying the force generated from the converter comprises an air supply cylinder and a nip roll loading cylinder.

14. The apparatus of claim 10 further comprising a plurality of pairs of adjustable nip rolls and a plurality of separator bars, a separate sheet of threads passing through each such pair of nip rolls and passing around each such separator bar, wherein each separator bar is equipped with a force measuring device, a controller, a converter, and a means for applying the force generated from the converter to the corresponding nip roll.

15. The apparatus of claim 10 wherein the separator bar is removably mounted on at least one lever, said lever being pivotally attached to the apparatus, and wherein the force measuring device is removably attached to said lever in such a way that the force applied by the threads to the separator bar is transmitted to the force measuring device.

* * * * *